US009010006B2

(12) United States Patent
Michel

(10) Patent No.: US 9,010,006 B2
(45) Date of Patent: Apr. 21, 2015

(54) TIME-DELAY MAGAZINE CATCH

(71) Applicant: Carl D Michel, Long Beach, CA (US)

(72) Inventor: Carl D Michel, Long Beach, CA (US)

( * ) Notice: Subject to any disclaimer, the term of this patent is extended or adjusted under 35 U.S.C. 154(b) by 0 days.

(21) Appl. No.: 14/556,506

(22) Filed: Dec. 1, 2014

(65) Prior Publication Data

US 2015/0075048 A1 Mar. 19, 2015

Related U.S. Application Data

(63) Continuation of application No. 14/171,017, filed on Feb. 3, 2014, now Pat. No. 8,925,229.

(60) Provisional application No. 61/760,273, filed on Feb. 4, 2013.

(51) Int. Cl.
*F41A 9/61* (2006.01)
*F41A 35/00* (2006.01)

(52) U.S. Cl.
CPC .. *F41A 35/00* (2013.01); *F41A 9/61* (2013.01)

(58) Field of Classification Search
USPC ..... 42/50, 18, 70.01, 90; 89/33.1
See application file for complete search history.

(56) References Cited

U.S. PATENT DOCUMENTS

| | | | | |
|---|---|---|---|---|
| 4,384,420 | A | 5/1983 | Muller | |
| 8,307,578 | B1 | 11/2012 | Azhocar | |
| 8,776,426 | B1 * | 7/2014 | Symonds | 42/90 |
| 2011/0010977 | A1 * | 1/2011 | Cash et al. | 42/50 |
| 2011/0056107 | A1 * | 3/2011 | Underwood | 42/18 |
| 2012/0198743 | A1 | 8/2012 | Bentley et al. | |
| 2012/0255209 | A1 | 10/2012 | Klassen | |
| 2014/0223791 | A1 | 8/2014 | Ruby et al. | |

* cited by examiner

*Primary Examiner* — J. Woodow Eldred
(74) *Attorney, Agent, or Firm* — Endurance Law Group, PLC

(57) ABSTRACT

A method and apparatus for intentionally slowing the speed at which detachable ammunition magazines can be interchanged in a firearm receiver. A magazine catch assembly includes a latch adapted to engage a recess of a standard magazine in the magazine well. A hand-activated crank interacts with threads of a push-rod portion of the latch so that manual rotation of the hand crank in one direction (e.g., counter-clockwise) displaces the latch after a sufficient number of turns. Reverse rotation of the hand crank returns the latch to its engaged condition ready to automatically re-engage the next magazine inserted into the firearm receiver. Alternatively, viscoelastic foam or other mechanical time-delay feature can be used instead of screw threads to introduce a mechanically transmitted dwell period before the latch is actuated.

20 Claims, 8 Drawing Sheets

TIME-DELAY MAGAZINE CATCH

CROSS REFERENCE TO RELATED APPLICATIONS

This application is a Continuation of U.S. Ser. No. 14/171,017 filed Feb. 3, 2014, which claims priority to Provisional Patent Application No. 61/760,273 filed Feb. 4, 2013, the entire disclosure of which is hereby incorporated by reference and relied upon.

BACKGROUND OF THE INVENTION

1. Field of the Invention

The invention relates generally to magazines for storing ammunition ready for chambering in a firearm and which may be detachable from the firearm, and more particularly to a release system therefor to prevent rapid interchange of magazines.

2. Description of Related Art

Repeating firearms are often fed successive rounds of ammunition from a magazine. Magazines may be integral to the firearm (fixed) or removable from the firearm (detachable). Removable magazines come in many shapes and sizes, with the most common type in modern firearms being the detachable box type. An example of a detachable box magazine may be found in U.S. Pat. No. 4,139,959, the entire disclosure of which is hereby incorporated by reference. A representative box magazine is generally indicated at 30 throughout the Figures.

As an example, in the popular AR-style rifle (FIG. 1), the magazine 30 is inserted into the firearm by pushing the magazine into a magazine well in the lower receiver, generally indicated at 32, until a spring-loaded pawl or latch 34 engages a notch-like recess 36 in the magazine 30 to securely hold the magazine 30 in an operational position.

To remove a magazine 30 from an AR-style rifle (it being understood that the AR platform is mentioned here as an example only, and that the principles of magazine insertion and replacement are generally similar across most makes and models of repeating firearms), a user depresses a magazine catch button 38 and then manually withdraws the magazine 30 (or allows the magazine 30 to simply fall under gravity) so that it disconnects completely from the lower receiver 32.

As originally designed and practiced in most jurisdictions, the Original Equipment (OE) magazine catch button 38 is thumb-operated. The user pushes the button 38 with their thumb (or finger) against the bias of a spring 40, which in turn displaces the catch 34 out of engagement with the magazine recess 36. Once pressure is released from the button 38, the latch 34 automatically returns to its natural or home position under the influence of the spring 40, ready for a new magazine 30 to be inserted and held fast. The prior art latch 34 and button 38 assembly is carried in a formed pocket in the lower receiver 32 of an AR-style firearm. Those of skill in this field will appreciate the magazine catch features of other firearm types may be designed and operate differently but upon the same general premises of a manually displaced, spring-loaded catch.

Since the magazine is an essential part of most repeating firearms, they are sometimes subject to regulation by gun control laws seeking to limit or handicap their functionality. Some jurisdictions impose regulations that seek to limit or handicap the detachment functionality of a magazine 30 and/or to characterize certain classes of firearms by the "detachable" nature of the magazine 30. For example, California law regulates "detachable" magazines 30. A magazine 30 is considered not "detachable" if one must use an external tool in order to remove the magazine 30. This determination has led to the development of numerous design proposals which modify a rifle so that its magazine 30 is not removable without the use of a tool, i.e., for which a human finger alone is not sufficient to depress the button 38. Despite the need for a special tool to release the magazine 30, practiced users may achieve relatively fast magazine 30 interchanges.

In addition to pressures imposed by laws and official ordinances, private gun ranges and/or instructional facilities may wish to impose restrictions on the speed at which a user can remove an empty magazine 30 and insert a fresh one into the firearm. Current techniques aimed at addressing the "detachable" nature of a magazine 30 may not reliably impede a user's ability to rapidly remove an empty magazine 30 and insert a fresh one into the firearm. There is therefore a need for new and improved options to control the speed at which a user can remove an empty magazine 30 and insert a fresh one into the firearm for those jurisdictions and settings where needed.

BRIEF SUMMARY OF THE INVENTION

According to a first aspect of this invention, a magazine catch assembly is provided for a detachable firearm magazine. The assembly includes a manual input member adapted for attachment to a firearm receiver and configured to receive an input motion from a user. A latch is supported for movement between engaged and disengaged conditions. The latch is configured to hold a detachable magazine in the receiver when in the engaged condition and to permit removal of the detachable magazine from the receiver when in the disengaged condition. A time delay unit is operatively disposed between said latch and said manual input member, said time delay unit responsive to the mechanical input motion at said manual input member to displace said latch between at least one of said engaged and disengaged conditions following a mechanically transmitted dwell period between the commencement of input motion received at said manual input member and the arrival of said latch to at least one of said engaged and disengaged positions.

The time delay unit delays the act of removing a detachable magazine from the firearm magazine well so that the user cannot quickly insert a new magazine. In jurisdictions where laws or ordinances so require, or in controlled settings like gun ranges and instructional facilities, the present invention facilitates the imposition of restrictions on the speed at which a user can remove an empty magazine and insert a fresh one into the firearm.

According to another aspect of this invention, a combination firearm receiver and detachable magazine therefor is provided. The combination includes a firearm receiver of the type including a magazine well configured to accept a detachable ammunition magazine therein, and a detachable ammunition magazine configured to be received in the magazine well of the receiver. The detachable magazine includes a recess. A magazine catch assembly is supported by the firearm receiver and adapted to selectively engage the recess of the detachable magazine disposed in the magazine well. The magazine catch assembly comprises a manual input member adapted for attachment to a firearm receiver and configured to receive an input motion from a user. A latch is supported for movement between engaged and disengaged conditions. The latch is configured to hold a detachable magazine in the receiver when in the engaged condition and to permit removal of the detachable magazine from the receiver when in the disengaged condition. A time delay unit is operatively disposed between said latch and said manual input member, said time delay unit responsive to the mechanical input motion at said manual input member to displace said latch between at least one of said engaged and disengaged conditions following a mechanically transmitted dwell period between the commencement of input motion received at said manual input member and the arrival of said latch to at least one of said engaged and disengaged positions.

According to a further aspect of this invention, a method for removing a detachable magazine from a firearm receiver is provided. The method includes retaining a detachable ammunition magazine in a magazine well of a firearm receiver, and supporting a latch in the firearm receiver for movement between engaged and disengaged conditions. The latch is configured to hold the detachable magazine in the magazine well when in the engaged condition and to permit removal of the detachable magazine from the magazine well when in the disengaged condition. The method further includes the step of applying a mechanical input motion to a manual input member that is operatively associated with the firearm receiver, and displacing the latch to one of the engaged and disengaged positions in direct response to the applying step. The improvement comprises mechanically delaying the displacing step after the applying step so that the detachable magazine cannot be immediately removed following the applying step.

In both the structure and method expressions of this invention, the act of removing a detachable magazine from the firearm magazine well is intentionally delayed so that the user cannot quickly insert a new magazine. In appropriate settings, the present invention facilitates a controlled reduction in the speed at which a user can remove an empty magazine and insert a fresh one into the firearm.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 3:
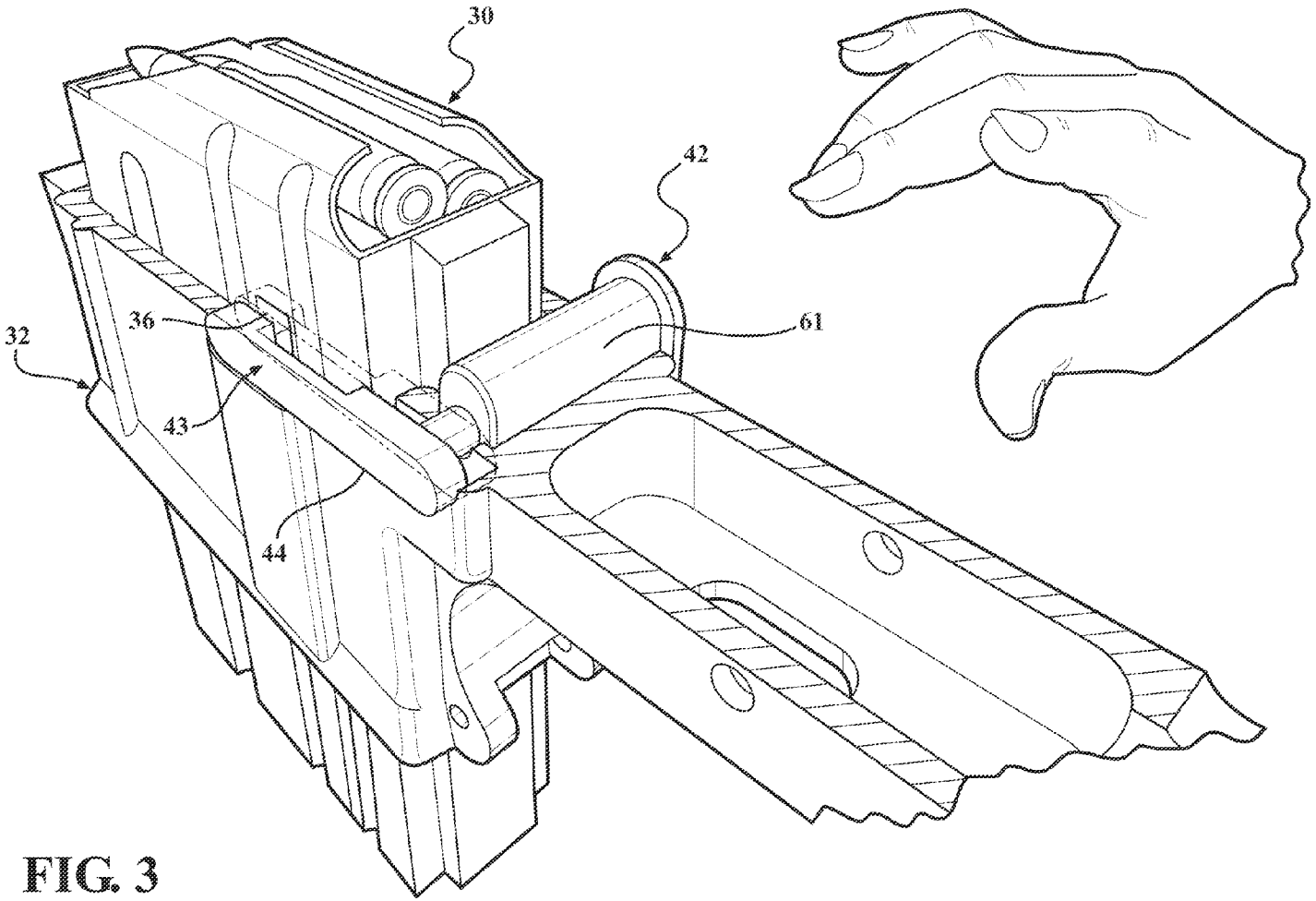
FIG. 3 is a fragmentary, cross-sectional view through the exemplary lower receiver portion to expose the magazine release catch assembly.

Referring to the figures wherein like numerals indicate like or corresponding parts throughout the several views, one embodiment of the present invention is shown in FIGS. 2-5 in the form of a magazine catch assembly, generally indicated at 42, including an electronic count-down timer. The magazine catch assembly 42 is preferably constructed to seat in the pocket formed in a standard (i.e., Original Equipment or OE) lower receiver 32 with little-to-no modification. Optionally, the OE catch 34 may be re-used with the magazine catch assembly 42. Preferably, however, a specially configured latch 43 is adapted for use with the magazine catch assembly 42, as will be described in detail below. The latch 43 is supported for movement between engaged and disengaged conditions. In FIG. 3, the latch 43 is shown in its disengaged condition in solid lines, and in its engaged condition in phantom lines. Conversely, in FIG. 5, the latch 43 is shown in its engaged condition in solid lines, and in its disengaged condition in phantom lines. The latch 43 is configured to hold a detachable magazine 30 in the receiver 32 when in the engaged condition and to permit removal of the detachable magazine 30 from the receiver 32 when in the disengaged condition.

Figure 4:
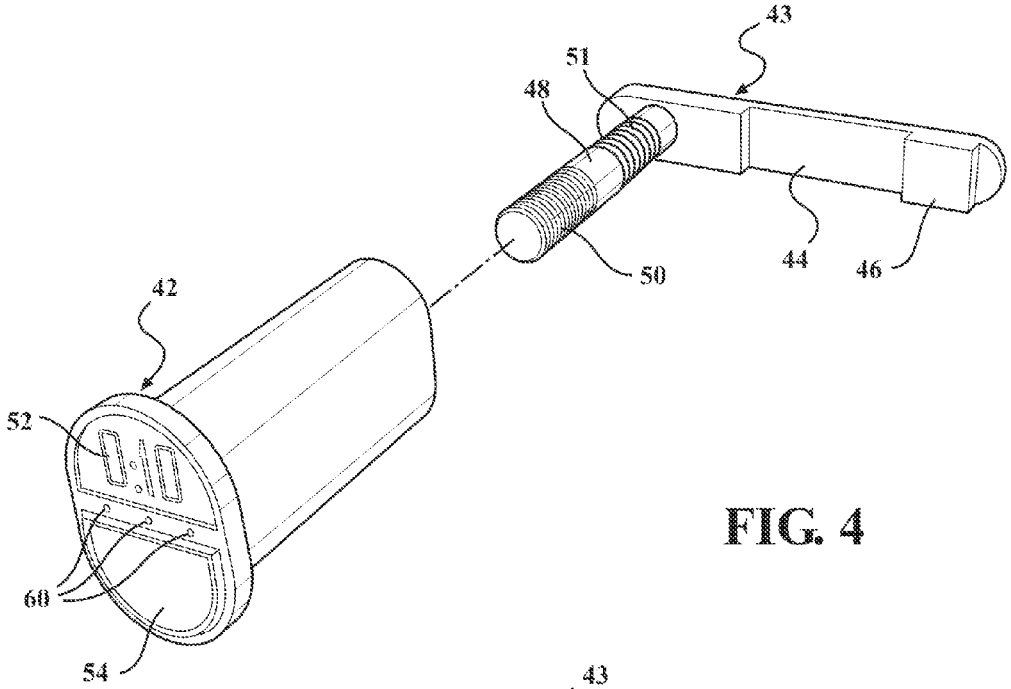
FIG. 4 is an exploded view of the magazine release catch assembly.
Figure 5:
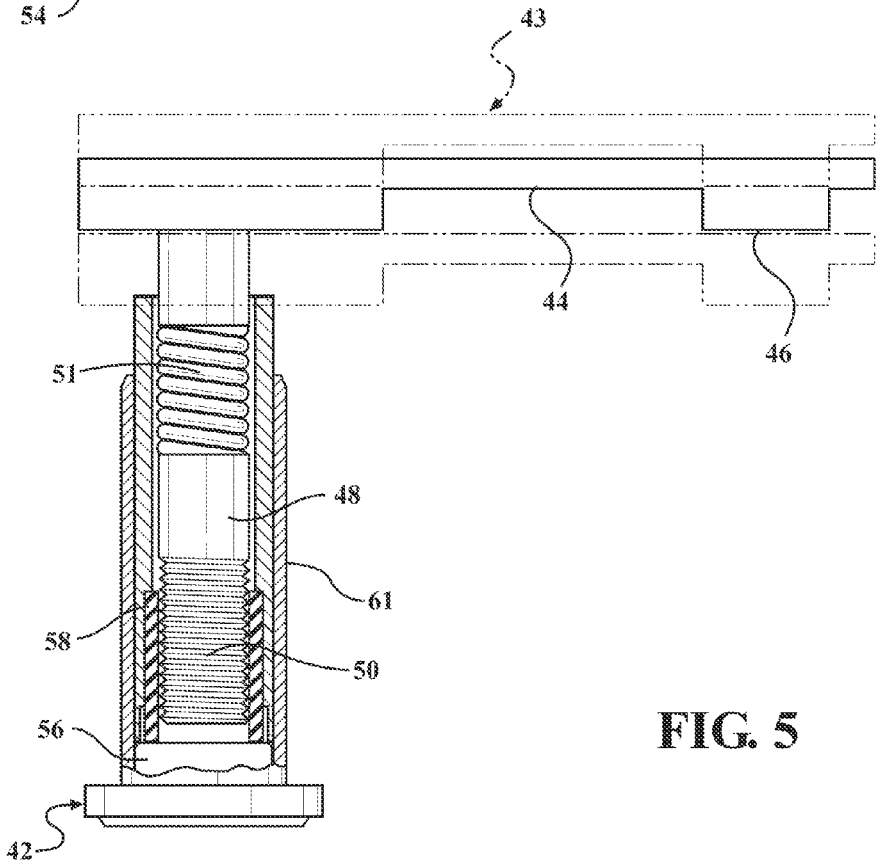
FIG. 5 is a top view of the magazine release catch assembly with its housing portion shown in cross-section and the latch member show in a disengaged condition in phantom lines.

As perhaps best shown in FIG. 4, the latch 43 includes a cantilever arm 44 that carries on its distal end a pad 46 sized to engage the recess 36 of a standard magazine 30 and hold the magazine 30 securely in the lower receiver 32. At the opposite end of the arm 44, an elongated push-rod 48 extends at a right angle as shown in FIG. 5. The push-rod 48 is adapted to extend through the lower receiver 32 so as to transmit motion to the arm 44. In one embodiment, threads 50 are formed on the distal end of the push-rod 48 for purposes to be described subsequently. The push-rod 48 may be formed in an axially expandable configuration. Such axial expandability is accomplished in one embodiment by an intermediate coil spring 51 which is capable of transmitting torsional forces—particularly in one rotary direction—with little to no yielding, however is readily expandable upon application of a modest axial stress. In this manner, the axially expandable push rod is spring biased toward a normally compressed condition like that shown in FIG. 5. In other words, the intermediate coil spring 51 is effective to bias the latch 43 toward its engaged condition. When the magazine well in the receiver 32 is empty and the latch 43 is in its engaged condition, a new magazine 30 can be forced into an operative position and locked in place in the magazine well without intentionally actuating the magazine catch assembly 42. More specifically, as the magazine 30 is pushed into the well, the rounded leading end of the magazine 30 will forcibly expand the push-rod 48 with a cam-like action thus displacing the latch 43 to its disengaged condition. As soon as the pad 46 registers with the recess 36 in the magazine, the bias action of the intermediate coil spring 51 will draw the latch 43 back toward its engaged condition and there hold the magazine fast in position until the magazine catch assembly 42 is intentionally actuated.

In the present invention, the magazine catch assembly 42 includes a user interface composed of a display screen 52 and an input pad 54. The display screen may be LCD, LED, OLED or any other suitable technology configured to display time markers (e.g., seconds). The input pad 54 is adapted for attachment to a firearm receiver and configured to receive an input signal from a user, or from another authorized source.

An actuator mechanism is operatively coupled to the latch 43 and responsive to the input signal at the input pad 54 to displace the latch 43 between at least one of its engaged and disengaged conditions. That is, the actuator mechanism can be configured to move the latch 43 from its engaged condition to its disengaged condition, or to move the latch 43 from its disengaged condition to its engaged condition, or preferably to move the latch 43 bilaterally between its engaged and disengaged conditions. The actuator mechanism may take any of various forms, but is shown in this embodiment including a direct-current electrical motor 56. The motor 56 has a rotary output, although other motor types are possible, including solenoid type motors and electro-magnetic drivers. The actuator mechanism also preferably includes a battery operatively connected to the motor 56.

An electronic delay circuit is operatively coupled to the input pad 54 for establishing a predetermined dwell period between the input signal received at the input pad and the displacement of the latch to at least one of the engaged and disengaged positions. The electronic delay circuit preferably includes an internal micro-processor that is provided with a non-transitory computer readable medium coded with instructions to perform the steps necessary to effect this invention. In particular, when the user presses on the input pad 54, the latch 43 remains stationary (i.e., engaging the recess 36 in the attached magazine 30) while the display screen 52 counts down the time markers to zero.

Upon reaching zero (or other specified end point), the micro-processor activates the internal servo-motor 56 to rotate, e.g., counterclockwise. An internally threaded driver cup 58 is driven by the output of the motor 56. The threaded cup 58 is operatively engaged with the threads 50 on the push-rod 48 of latch 43. The rotational direction of the threaded cup 58 is such that the push-rod 48 is longitudinally displaced like a power screw for a sufficient distance (i.e., after a pre-programmed number of turns) so that the pad 46 of the latch 43 clears the recess 36 of the magazine 30, thus moving to is fully disengaged condition. Rotation of the driver cup 58 causes a corresponding linear translation of the push rod 48. Bi-directional rotation of the motor 56 will cause alternating translation of the push-rod 48 so that the latch 43 is displaced bilaterally between its engaged and disengaged conditions depending on the rotational direction of the motor 56.

Figure 1:
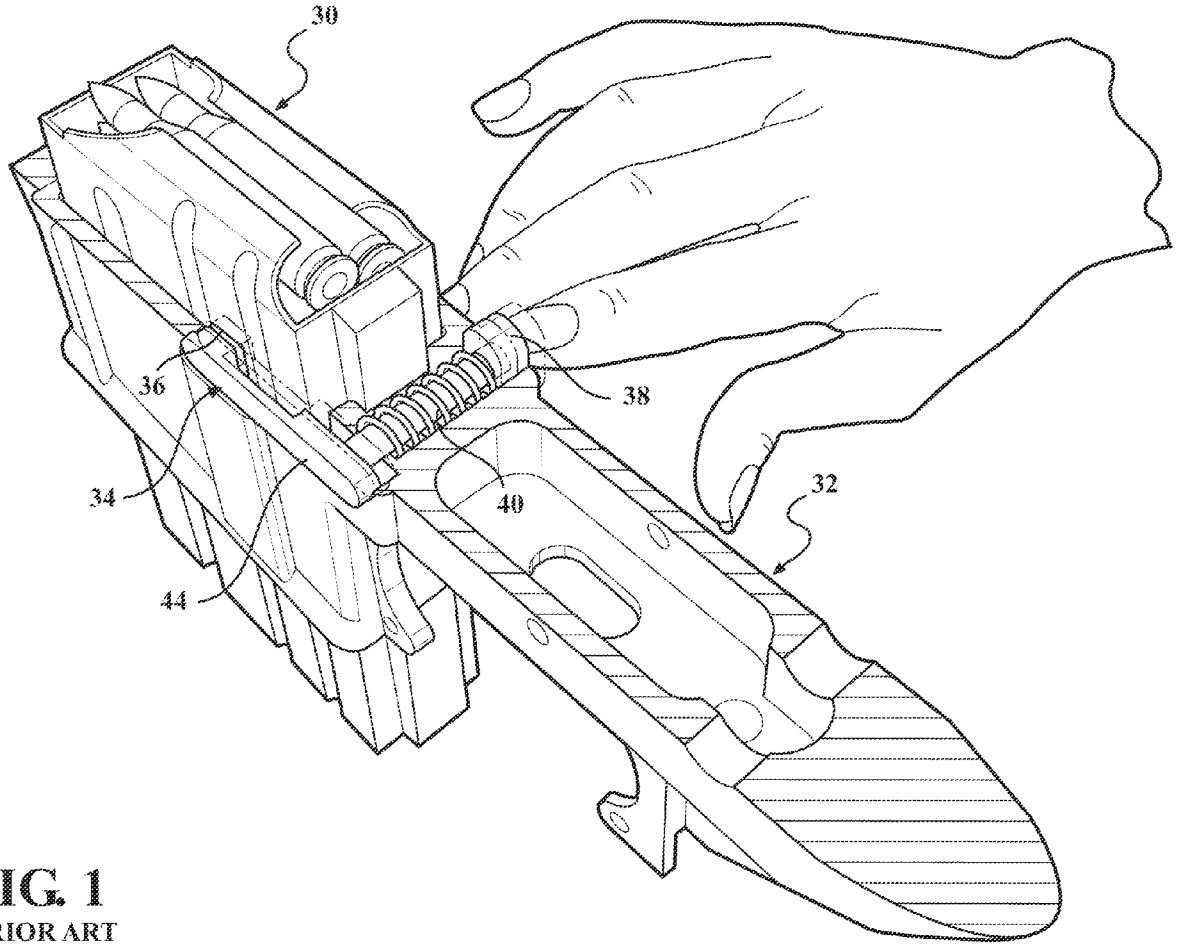
FIG. 1 PRIOR ART
FIG. 1 is a cross-sections view through the lower receiver portion of an exemplary AR-15 firearm configured with a prior art style magazine release catch assembly.
Figure 2:
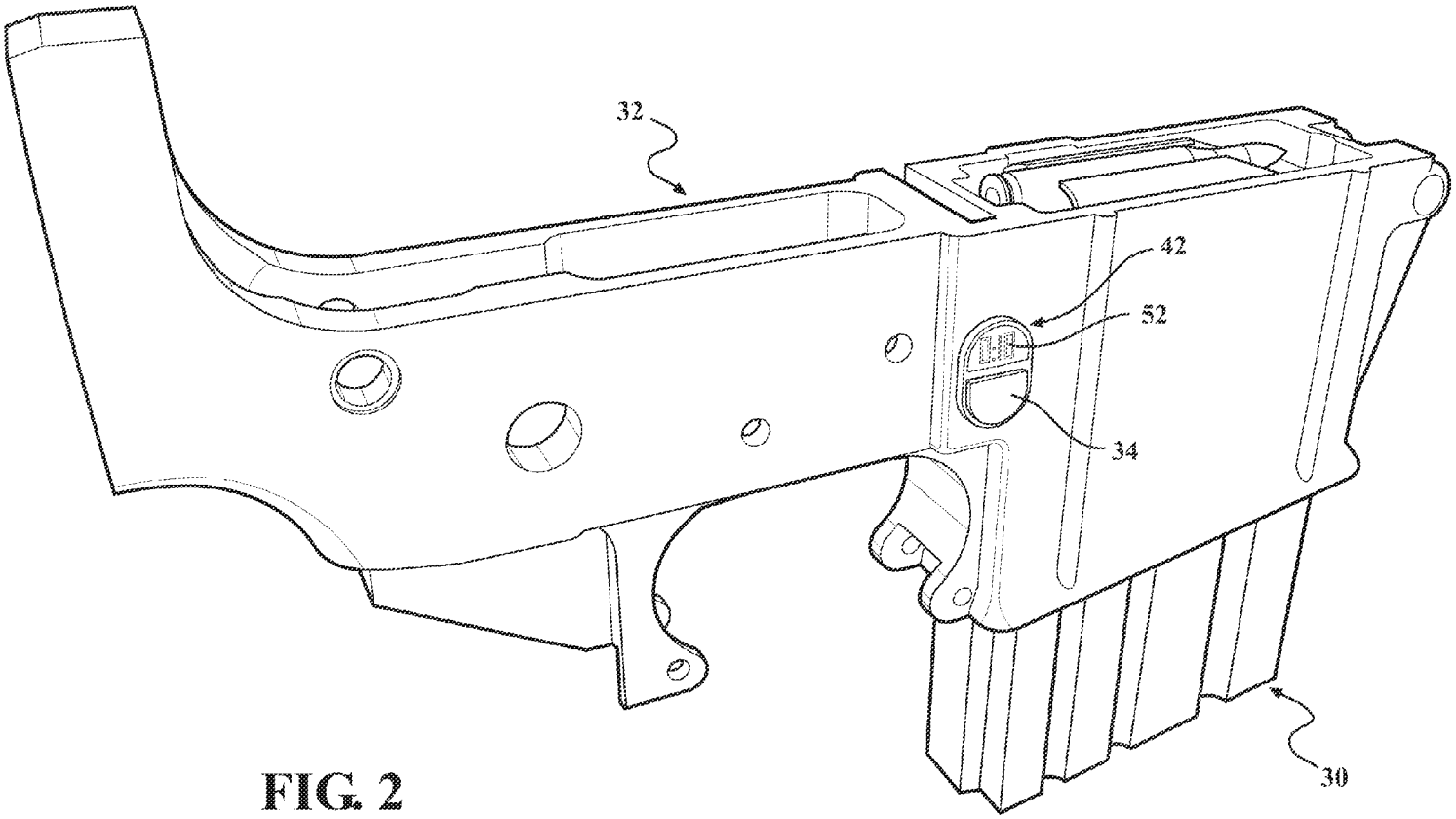
FIG. 2 is a perspective view of a lower receiver portion of an exemplary AR-15 firearm configured with a magazine release catch assembly according to one embodiment of the present invention.

In this embodiment, the magazine catch assembly 42 includes a housing 59 that is sized to fit with a snug frictional fit in the pocket of the receiver 32 normally prepared for a prior art button 38 and spring 40 (FIG. 1). The housing 59 supports the latch 43 and the input pad 54 and also the electronic delay circuit. Batteries may also be included within the unit housing 59, or remotely connected via suitable wire leads (not shown). Alternatively still, rechargeable batteries may be included in the system with a generator connected to moving parts of the firearm that generate recharging electricity each time the firearm is fired. Of course, solar-power and other plug-in forms of recharging the batteries are also contemplated. Although not shown in the cross-section through the housing 59 in FIG. 5, an anti-rotation feature may be provided between the push-rod 48 and the housing 59 to constrain the push-rod 48 to non-rotational linear relative movements. For example, the push-rod 48 may be non-circular and trapped in a mating shape in the housing that prevents relative rotation therebetween.

The processor may be programmed to automatically retract the latch 43 (by reversing rotation of the cup 58—e.g., clockwise—for the specified number of turns) so that the latch 43 is ready to automatically re-engage the next magazine 30 inserted into the lower receiver 32. A time-delay can be programmed into the system so that automatic retraction of the latch 43 occurs within a certain number of seconds after full extension of the latch 43 is reached. Alternatively the retraction could be programmed to require a manual input signal, such as by depressing again the input pad 54, in order to initiate the latch 43 retraction sequence. As mentioned previously, when the magazine well in the receiver 32 is empty and the latch 43 is in its engaged condition, a new magazine 30 can be forced into an operative position and locked in place in the magazine well via the bias action of the intermediate coil spring 51.

The drawings illustrate a 10-second pre-programmed time marker countdown on the display screen 52. This duration can be any desired amount (e.g., 15 seconds or 20 seconds, etc.). Also, the duration can be factory set and unalterable, or reconfigurable by the user or a qualified gun-smith. One or more settings holes 60 (FIG. 4) may be provided to receive the tip of a paperclip or ball-point pen so that an operator can change control settings. For example, one hole 60 might comprise a system re-set. Another hole 60 might allow adjustment of the time "release" time duration, which is the amount of time delay between initial input to the input pad 54 and displacement of the latch 43 (i.e., when the magazine 30 can be removed from the receiver 32). A still further hole 60 might be used to adjust the retraction time settings. For example, whether the latch 43 automatically retracts at some specified time interval following displacement, or whether manual input it required. Of course, other useful parameters and/or setting may also be adjusted via the holes 60. The one or more settings holes 60 may be located internally of the receiver 32 so that some disassembly of the firearm is required in order to access the hole(s) 60.

Optionally, the magazine catch assembly 42 may include technology that is responsive to an authorized wireless override signal. For example, the magazine catch assembly 42 may include RFID or Bluetooth technology, or other types of features that are responsive to remote input signals that may be used by suitable authorized personnel, including for example law enforcement or range masters. In proper circumstances, an authorized person may wish to initiate a wireless input signal that is capable of over-riding the user's actions and forcing the latch 43 toward a continuous disengaged condition. For example, in an emergency or safety-sensitive situation, a wireless input signal may be generated that will render the firearm incapable of receiving a detachable magazine. Or, a gun owner may wish to remotely disable their firearm with a key fob type signal generator, such as when an unauthorized person threatens to take possession of their firearm. Many other uses and applications will become apparent.

The mechanics of displacing the latch 43 can be as varied as the imagination of the ordinary engineer. For example, instead of the above-described motor-driven jack-screw arrangement, the pushrod 48 could interact magnetically with the magazine catch assembly 42. Or the pushrod 48 could comprise the armature of a solenoid-type arrangement. Or a rotary barrel cam design might be designed into the interface between latch 43 and motor 56. Or any of the foregoing electro-mechanical approaches could be a prerequisite for displacement of latch 43 via human muscle force. Many possible mechanical and electro-mechanical relationships can be discerned by the person of ordinary skill in the art, with the preceding examples offered as initial illustrations only.

Figure 6:
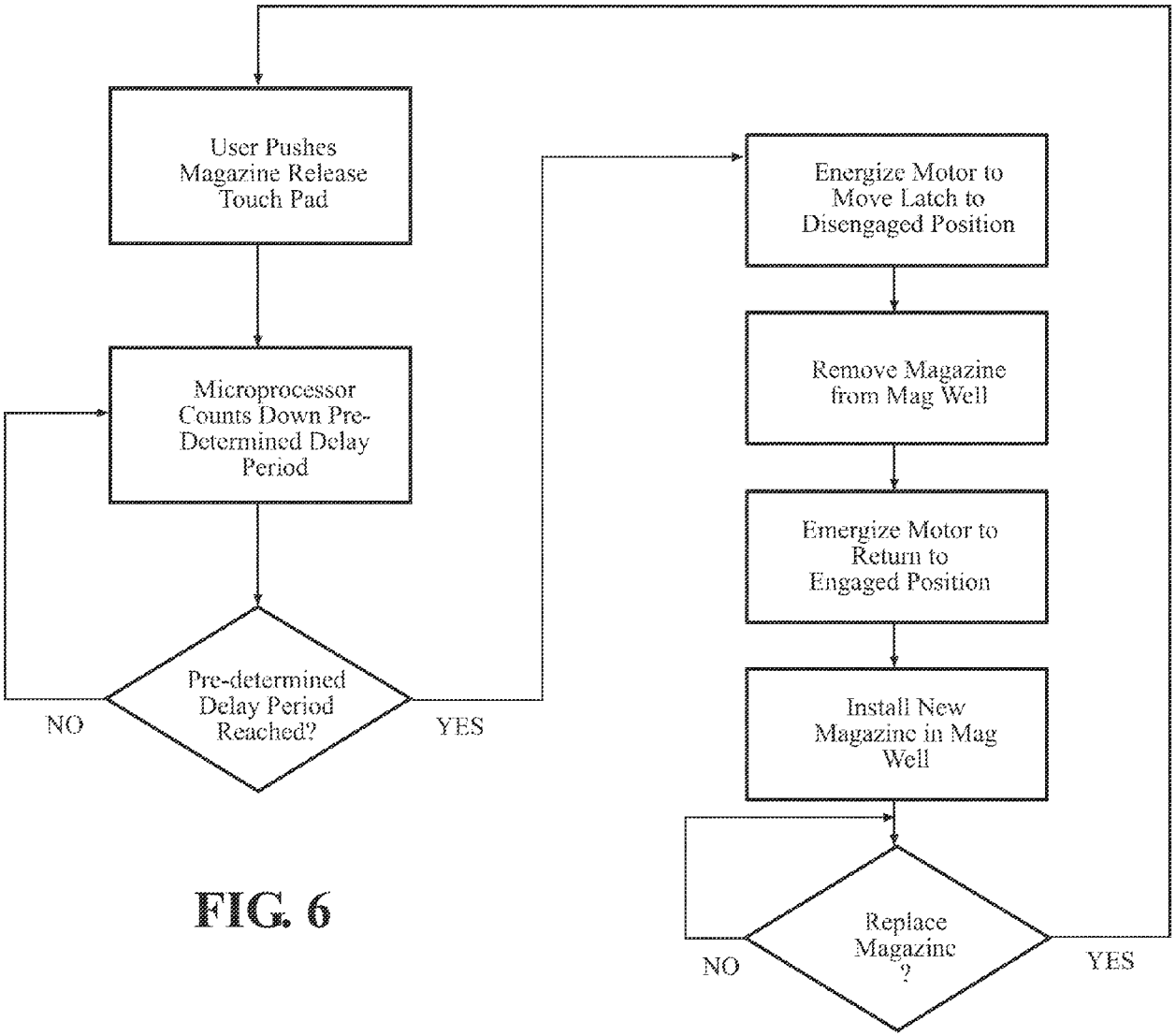
FIG. 6 is a simplified flow diagram depicting a method of the present invention according to the first-disclosed embodiment.

FIG. 6 depicts a simplified flow diagram of a method of the present invention wherein a detachable magazine is removed from a firearm receiver. According to this method, a detachable ammunition magazine is retained in a magazine well of a firearm receiver 32. A latch 43 is supported in the firearm receiver 32 for movement between engaged and disengaged conditions. The latch 43 is configured to hold the detachable magazine 30 in the magazine well when in the engaged condition and to permit removal of the detachable magazine from the magazine well when in the disengaged condition. An input signal is applied via a user input pad 54 that is operatively associated with the firearm receiver. The input signal can be generated by the user pushing the input pad 54 with their finger or with a special tool or via a wireless signal. In direct response to the aforementioned applying step, the latch 43 is displaced to one of the engaged and disengaged positions. However, the improvement of this method can be observed in the step of delaying the displacement of the latch 43 by a predetermined dwell or delay period (e.g., 10 seconds) after the input signal is applied so that the detachable magazine 30 cannot be immediately removed following generation of the input signal. Once the predetermined delay period had been reached, the motor 56 is energized to move the latch 43 to its disengaged position. The user is then free to remove the magazine 30 from the mag well. Either automatically or by user initiated action, the motor 56 is energized to return the latch 43 to its engaged position whereupon a new magazine 30 can be placed into service. If the latch 43 is moved to its engaged position prior to insertion of a new magazine 30, the latch 43 will automatically displace against the bias of the intermediate coil spring 51 when the new detachable magazine 30 is inserted in the magazine well.

Figure 7:
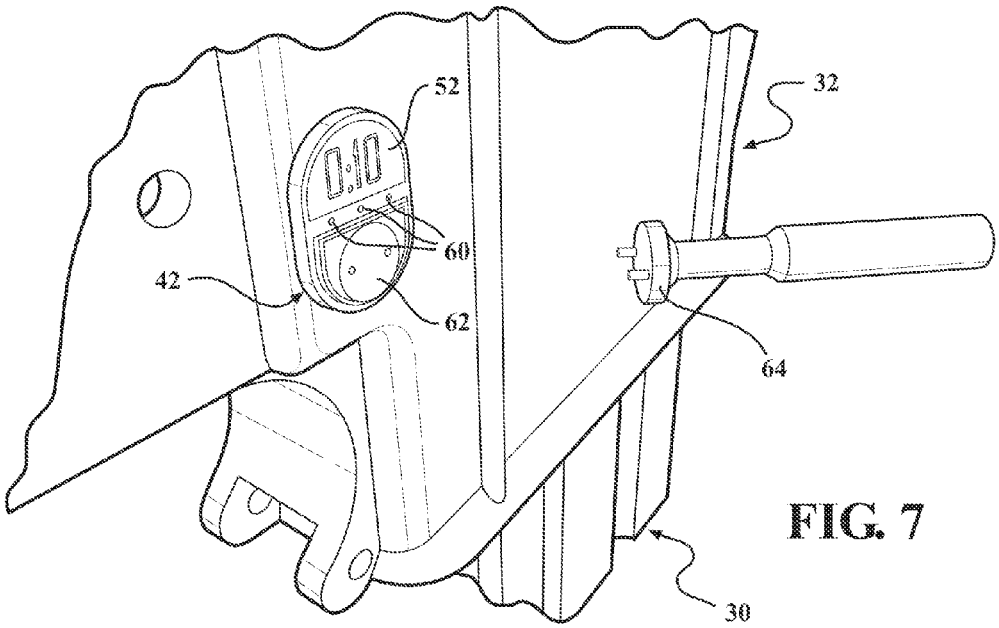
FIG. 7 is a view showing an alternative embodiment of the input pad in which a specialized tool is required to generate the necessary input signal.

FIG. 7 illustrates a first alternative embodiment of the invention wherein the input pad is replaced by a tool interface 62. In this configuration, an unaided human hand is not capable of generating the input signal needed to activate the magazine catch assembly 42. Instead, a special tool 64 is required to activate the count-down sequence described above. The specific type of tool 64 and interface geometry can be varied to suit the needs and/or application, with the two-prong stylus shown merely for illustrative purposes. It should be appreciated that the special tool 4 need not necessarily make physical contact with the tool interface 62, but may operate through magnetic, electro-magnetic or other wireless methods.

Figure 8:
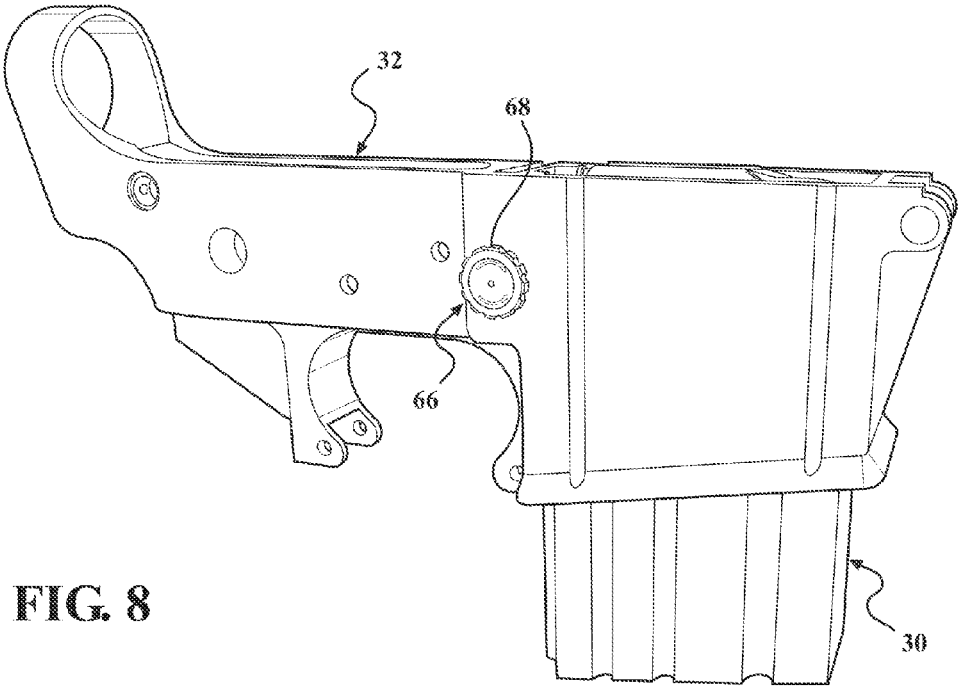
FIG. 8 is a perspective view of a second alternative embodiment in which the input pad is configured to receive an input signal in the form of multiple rotational revolutions.
Figure 9:
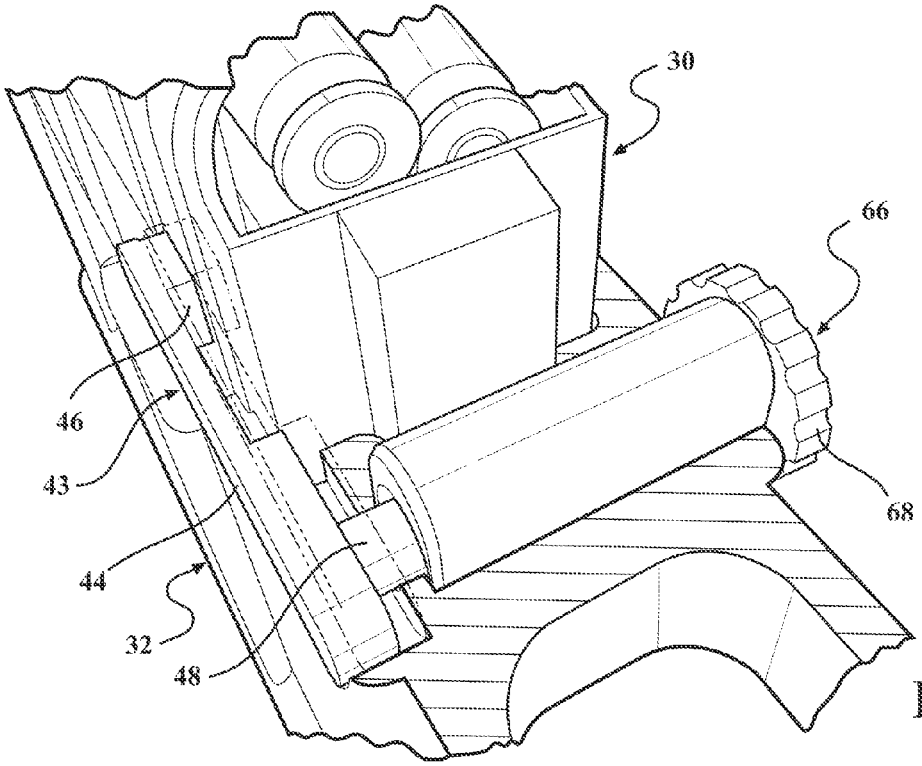
FIG. 9 is a fragmentary, cross-sectional view through an exemplary lower receiver portion to expose the magazine release catch assembly according to the second alternative embodiment of FIG. 8.
Figure 10:
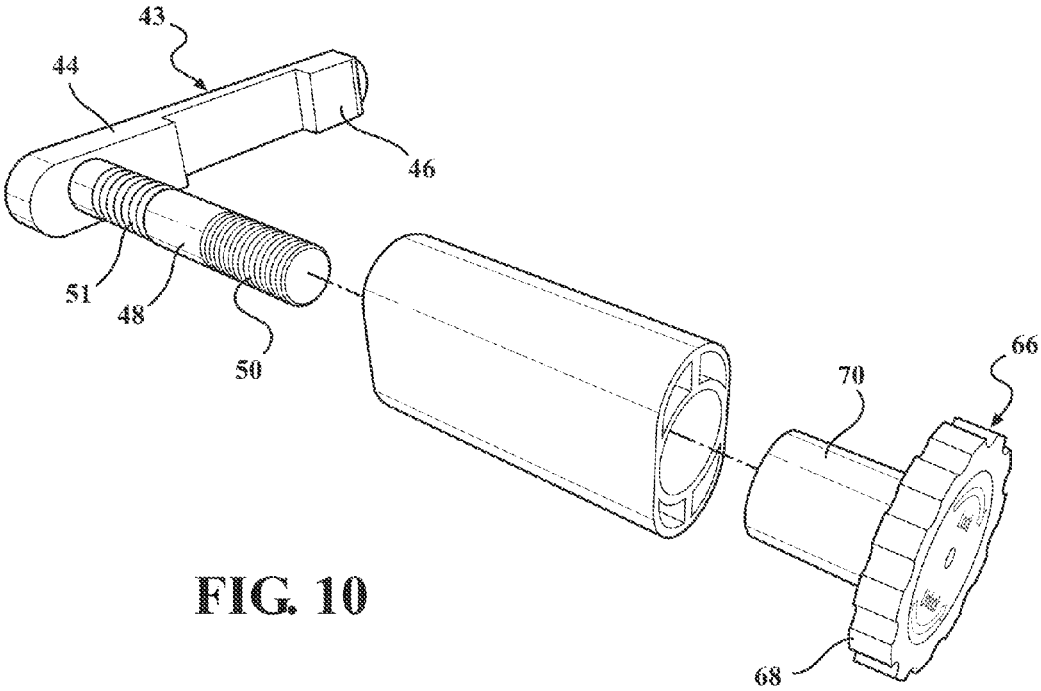
FIG. 10 is an exploded view of the magazine release catch assembly according to the second alternative embodiment of FIG. 8.

FIGS. 8-10 depict a second alternative embodiment of the present invention that is non-electrical in design. According to this embodiment, a time-delay unit is generally indicated at 66. The time-delay unit 66 is designed to operate with the above-described latch 43. It being understood, however, that it is here also possible to configure a latch that utilizes different mechanics to displace the catch. These alternatives may include magnetic interactions, rotary cams, special resilient materials (e.g., viscoelastic memory foam), and the like.

In the depicted embodiment, a hand-activated screw cap 68 includes a threaded cup 70 that interacts with the threads 50 of the push-rod 48 in substantially the same manner described above. Manual rotation of the screw cap 68 in one direction (e.g., counter-clockwise) longitudinally displaces the push-rod 48 like a jack screw so that after a sufficient number of turns the pad 46 of the latch 43 clears the recess 36 of the magazine 30. Reverse rotation of the screw cap 68 returns the latch 43 to its engaged condition ready to automatically re-engage the next magazine 30 inserted into the lower receiver 32. Alternatively, an automatic retraction feature (not shown) may be designed into the system so that the latch 43 is ready to automatically re-engage the next magazine 30 inserted into the lower receiver 32. This may be accomplished in any variety of mechanical methods, the design of which is well-within the ordinary skill of a qualified gun-smith and/or firearms design engineer. Furthermore, there is preferably included a spring interface 51 disposed somewhere along the working components of the latch 43 that will allow the latch 43 to operate in a traditional manner to temporarily bias out of position while a new magazine 30 is being inserted but to snap abruptly back into position once its pad 46 aligns with the magazine recess 36.

The time required to manually displace the latch 43 using the time-delay unit 66 will accomplish the purposes of this invention—namely to control the speed at which a user can remove an empty magazine 30 and insert a fresh one into the firearm for those jurisdictions and settings where needed.

Figure 11:
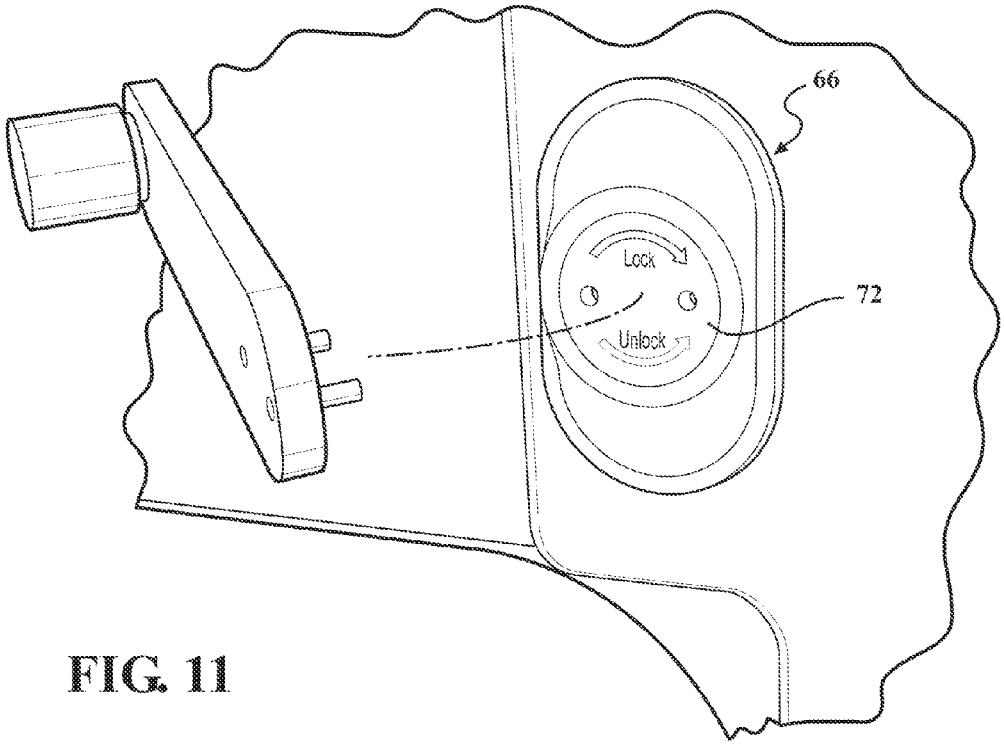
FIG. 11 depicts a third alternative embodiment in which the input pad is configured to receive an input signal in the form of multiple rotational revolutions via a specialized tool.
Figure 12:
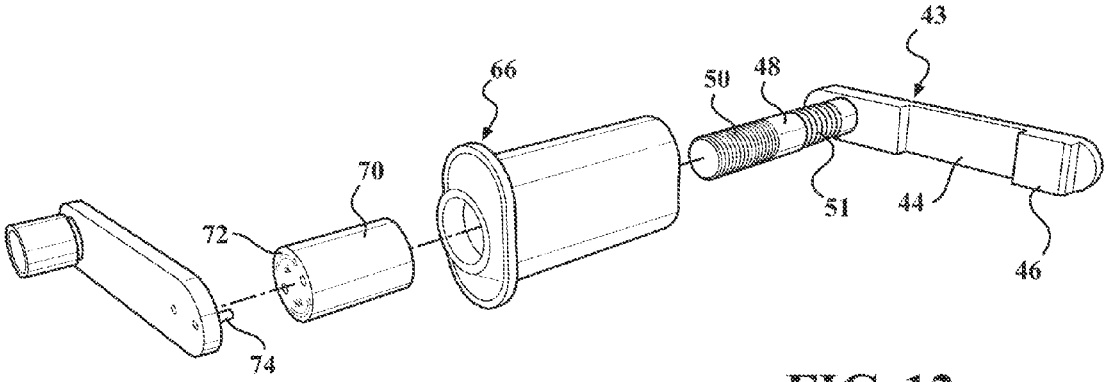
FIG. 12 is an exploded view of the magazine release catch assembly according to the third alternative embodiment of FIG. 11.

FIGS. 11-12 illustrate a third alternative embodiment of the invention wherein the hand-activated screw cap 68 is replaced by a tool interface 72. In this configuration, an unaided human hand is not capable of activating the time-delay unit 66. Instead, a special tool 74 is required to displace the latch 43. The specific type of tool 74 and interface geometry can be varied to suit the needs and/or application, with the two-prong spanner shown merely for illustrative purposes.

In a still further variation of this concept, not shown, a hybrid electrical and manual time-delay feature is proposed. In this example, an electric servo-motor 56 is used as in the first embodiment, but no battery supply is made available. Instead, in order to generate electricity to activate the servo-motor 56, the user must manually crank a generator (not shown) to generate sufficient electricity to power the motor 56 each time it is desired to remove a magazine. For example, a small rotary hand crank or pump action feature is paired with a small but sufficient electrical generator (like those found in hand-crank radios and flashlights) to energize the servo-motor 56. The motor 56 (possibly teamed with a suitable capacitor) may be powerful enough to hold the latch 43 out of engagement with the magazine recess 36 against a biasing spring (not shown). When the energy subsides, or when some time-activated mechanical feature yields (e.g., viscoelastic memory foam), the spring returns the catch to a normal engagement condition so that the next inserted magazine 30 is automatically retained in the lower receiver 32.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A magazine catch assembly for a detachable firearm magazine, said assembly comprising:

a manual input member adapted for attachment to a firearm receiver and configured to receive a input motion from a user, a latch supported for movement between engaged and disengaged conditions, said latch configured to hold a detachable magazine in the receiver when in said engaged condition and to permit removal of the detachable magazine from the receiver when in said disengaged condition, a time delay unit operatively disposed between said latch and said manual input member, said time delay unit responsive to the mechanical input motion at said manual input member to displace said latch between at least one of said engaged and disengaged conditions following a mechanically transmitted dwell period between the commencement of input motion received at said manual input member and the arrival of said latch to at least one of said engaged and disengaged positions.

2. The assembly of claim 1, wherein said manual input member includes a hand-crank.

3. The assembly of claim 1, wherein said manual input member includes a tool interface.

4. The assembly of claim 1, wherein said time delay unit includes a viscoelastic memory foam.

5. The assembly of claim 1, wherein said time delay unit includes a hand-crank electric generator.

6. The assembly of claim 1, wherein said time delay unit comprises a driver cup.

7. The assembly of claim 6, wherein said driver cup includes female thread forms, and wherein said latch includes a push rod, said push rod including male thread forms in cooperation with said female thread forms in said driver cup so that rotation of said driver cup causes a corresponding linear translation of said push rod.

8. The assembly of claim 1, wherein said latch includes a push rod, said push rod being axially expandable, said axially expandable push rod being spring biased toward said engaged condition.

9. The assembly of claim 1, further including a housing, said housing supporting said latch and said manual input member and said time delay unit.

10. A combination firearm receiver and detachable magazine therefor, said combination comprising:

a firearm receiver including a magazine well configured to accept a detachable ammunition magazine therein, a detachable ammunition magazine configured to be received in said magazine well of said receiver, said detachable magazine including a recess, a magazine catch assembly supported by said firearm receiver and adapted to selectively engage said recess of said detachable magazine disposed in said magazine well, said magazine catch assembly comprising:

a manual input member adapted for attachment to a firearm receiver and configured to receive a input motion from a user, a latch supported for movement between engaged and disengaged conditions, said latch configured to hold said detachable magazine in said magazine well when in said engaged condition and to permit removal of said detachable magazine from said magazine well when in said disengaged condition, a time delay unit operatively disposed between said latch and said manual input member, said time delay unit responsive to the mechanical input motion at said manual input member to displace said latch between at least one of said engaged and disengaged conditions following a mechanically transmitted dwell period between the commencement of input motion received at said manual input member and the arrival of said latch to at least one of said engaged and disengaged positions.

11. The assembly of claim 10, wherein said manual input member includes a hand-crank.

12. The assembly of claim 10, wherein said manual input member includes a tool interface.

13. The assembly of claim 10, wherein said time delay unit includes a viscoelastic memory foam.

14. The assembly of claim 10, wherein said time delay unit includes a hand-crank electric generator.

15. The assembly of claim 10, wherein said time delay unit comprises a driver cup.

16. The assembly of claim 15, wherein said driver cup includes female thread forms, and wherein said latch includes a push rod, said push rod including male thread forms in cooperation with said female thread forms in said driver cup so that rotation of said driver cup causes a corresponding linear translation of said push rod.

17. The assembly of claim 10, wherein said latch includes a push rod, said push rod being axially expandable, said axially expandable push rod being spring biased toward said engaged condition.

18. The assembly of claim 10, further including a housing, said housing supporting said latch and said manual input member and said time delay unit.

19. A method for removing a detachable magazine from a firearm receiver, said method comprising the steps of:

retaining a detachable ammunition magazine in a magazine well of a firearm receiver, supporting a latch in the firearm receiver for movement between engaged and disengaged conditions, the latch configured to hold the detachable magazine in the magazine well when in the engaged condition and to permit removal of the detachable magazine from the magazine well when in the disengaged condition, applying a mechanical input motion to a manual input member operatively associated with the firearm receiver, displacing the latch to one of the engaged and disengaged positions in direct response to said applying step, wherein the improvement comprises mechanically delaying said displacing step after said applying step so that the detachable magazine cannot be immediately removed following said applying step.

20. The method of claim 19, wherein said displacing step comprises moving the latch from the engaged position to the disengaged position, and further including returning the latch to the engaged position prior to inserting a new detachable magazine in the magazine well, and automatically displacing the latch against a spring bias when a new detachable magazine is inserted in the magazine well.

* * * * *